US007913993B2

(12) United States Patent
Kosugi et al.

(10) Patent No.: US 7,913,993 B2
(45) Date of Patent: Mar. 29, 2011

(54) SHEET FEEDING DEVICE, SHEET FEEDING UNIT AND IMAGE FORMING APPARATUS CONNECTED WITH THE SHEET FEEDING UNIT WITH A CONTROLLED FLOATING AIR BLOWING MECHANISM

(75) Inventors: Akira Kosugi, Hachioji (JP); Daisuke Ueda, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/632,946

(22) Filed: Dec. 8, 2009

(65) Prior Publication Data

US 2010/0148425 A1 Jun. 17, 2010

(30) Foreign Application Priority Data

Dec. 11, 2008 (JP) ..... 2008-316053

(51) Int. Cl.
*B65H 3/14* (2006.01)

(52) U.S. Cl. ..... 271/98; 271/12

(58) Field of Classification Search ..... 271/90–108, 271/30.1–31.1

See application file for complete search history.

(56) References Cited

U.S. PATENT DOCUMENTS

| | | | | |
|---|---|---|---|---|
| 5,344,133 | A * | 9/1994 | Jantsch et al. | 271/98 |
| 6,554,269 | B1 * | 4/2003 | Dobbertin et al. | 271/90 |
| 7,744,081 | B2 * | 6/2010 | Ikeda | 271/98 |

FOREIGN PATENT DOCUMENTS

| | | | |
|---|---|---|---|
| JP | 60-56739 | A | 4/1985 |
| JP | 60056739 | A * | 4/1985 |
| JP | 7-89625 | A | 4/1995 |
| JP | 2004189432 | A * | 7/2004 |
| JP | 2005-75540 | A | 3/2005 |
| JP | 2005-96993 | A | 4/2005 |
| JP | 2005104723 | A * | 4/2005 |

* cited by examiner

*Primary Examiner* — Stefanos Karmis
*Assistant Examiner* — Gerald W McClain
(74) *Attorney, Agent, or Firm* — Cantor Colburn LLP

(57) ABSTRACT

A sheet feeding device may include a sucking and conveying mechanism having a suction surface, which sucks sheets stacked on a sheet stacking table, from an upper surface of the sheets, sucks an uppermost sheet to be sucked on the suction surface, and conveys the uppermost sheet onto a sheet conveyance path; a floating air blowing mechanism which blows floating air against the sheets from a side surface of the stacked sheets; a sheet position detecting sensor which detects an upper surface height position of the sheets stacked, and detects a floating state of the sheets floated; and a controller which judges the floating state of the sheets detected in a floating state detecting period in connection with a blowing of the floating air, and controls an air volume of floating air blown from the floating air blowing mechanism based on the floating state of the sheets.

17 Claims, 8 Drawing Sheets

| | BASIS WEIGHT (g/m²) | | | | | | |
|---|---|---|---|---|---|---|---|
| | 40-49 | 50-61 | 62-71 | 72-91 | 92-130 | 131-161 | 162- |
| NUMBER OF ON/OFF SWITCHING | 3-5 TIMES | 2-4 TIMES | 2-4 TIMES | 1-3 TIMES | 1-3 TIMES | 1-2 TIMES | 1 TIME |
| CUMULATIVE ON-PERIOD OF TIME | 20-60% | 30-70% | 40-80% | 30-70% | 40-80% | 50-90% | 40-90% |

| | BASIS WEIGHT ($g/m^2$) | | | | | | |
|---|---|---|---|---|---|---|---|
| | 40-49 | 50-61 | 62-71 | 72-91 | 92-130 | 131-161 | 162- |
| NUMBER OF FAN REVOLUTION | A 20% | B 30% | C 40% | D 50% | E 70% | F 80% | G 100% |

FIG. 6

| | BASIS WEIGHT (g/m²) | | | | | | |
|---|---|---|---|---|---|---|---|
| | 40-49 | 50-61 | 62-71 | 72-91 | 92-130 | 131-161 | 162- |
| NUMBER OF ON/OFF SWITCHING | 3-5 TIMES | 2-4 TIMES | 2-4 TIMES | 1-3 TIMES | 1-3 TIMES | 1-2 TIMES | 1 TIME |
| CUMULATIVE ON-PERIOD OF TIME | 20-60% | 30-70% | 40-80% | 30-70% | 40-80% | 50-90% | 40-90% |

SHEET FEEDING DEVICE, SHEET FEEDING UNIT AND IMAGE FORMING APPARATUS CONNECTED WITH THE SHEET FEEDING UNIT WITH A CONTROLLED FLOATING AIR BLOWING MECHANISM

This application is based on Japanese Patent Application No. 2008-316053 filed on Dec. 11, 2008, which is incorporated hereinto by reference.

BACKGROUND OF THE INVENTION

The present invention relates to a sheet feeding device wherein sheets stacked on a sheet stacking table are sucked to a suction surface by air to be fed out, and in particular, to an object wherein an air volume of floating air is made to be reasonable based on the state of floating in the case of blowing floating air against sheets stacked on the sheet stacking table.

An air sheet feeder has been used as a sheet feeding device of an image forming apparatus such as a copying machine. In the sheet feeding device, there is employed a mechanism wherein air is blown against a side edge surface of stacked sheets, and a sheet thus floated is sucked on a suction surface such as a perforated belt on which a suction opening that draws air is formed, and the belt is driven to rotate to convey the sheet.

With respect to the air sheet feeder of this kind, there has been proposed a technology in which an air volume is made to be variable depending on a sheet type (for example, see Unexamined Japanese Patent Application Publication No. 2005-75540). Further, there has been proposed a technology in which sheet feeding timing is detected to judge presence or absence of sheet feeding delay, and an air blowing operation is carried out (for example, see Unexamined Japanese Patent Application Publication No. 2005-96993).

In addition, there has been proposed a technology in which a period of time up to suction for sheet suction detection is measured to compare the measured time with a reference value, thus, the air volume is made to be variable (for example, see Unexamined Japanese Patent Application Publication No. S60-56739). There has further been proposed a technology to control an air volume by detecting a sheet floating position (for example, see Unexamined Japanese Patent Application Publication No. H07-89625).

In the technology described in Unexamined Japanese Patent Application Publication No. 2005-75540, it is impossible to cope with dispersion of the states in the same sheet type and with an influence of the state of keeping for sheets, because conditions are fixed by the sheet type. Further, in the technology described in Unexamined Japanese Patent Application Publication No. 2005-96993, it is impossible to judge whether floating of the sheet is appropriate or not, because a judgment is one under the state of sheet feeding. In the technologies described in Unexamined Japanese Patent Application Publication Nos. S60-56739 and H07-89625, a state is detected for the uppermost sheet among stacked sheets, and states of the second sheet and thereafter which are fed continuously are not reflected on the control of air volume.

Therefore, there have been generated dispersions on states of floating by air, and sure separation and conveyance of sheets have been impossible, resulting in problems.

SUMMARY OF THE INVENTION

The first aspect for solving the aforesaid problems is a sheet feeding device having therein a sheet stacking table that has thereon stacked plural sheets and goes up and down in the direction of stacking sheets, a sucking and conveying mechanism that sucks a sheet stacked on the sheet stacking table from the upper surface, then, causes the uppermost sheet to be sucked on a suction surface and conveys the sheet sucked on the suction surface to a sheet conveyance path, a floating air blowing mechanism that blows floating air against the sheet from the side of sheets stacked on the sheet stacking table, a sheet position detecting sensor that detects an upper surface position of sheets stacked on the sheet stacking table and detects the state of floating of the sheet floated by the aforesaid floating air, and a controller that judges the state of floating of the sheet detected by the aforesaid sheet position detection sensor in floating state detecting period interlocked with blowing out of the aforesaid floating air, and controls an air volume of floating air blown out of the floating air blowing mechanism based on the floating state of the sheet.

The second aspect is a sheet feeding unit having therein a single or plural sheet trays which will store sheets, a sheet stacking table that has thereon stacked plural sheets which are stacked on the sheet tray and goes up and down in the direction of stacking sheets, a sucking and conveying mechanism that sucks sheets stacked on a sheet stacking table from the upper surface, then, causes the uppermost sheet to be sucked on a suction surface and conveys the sheet sucked on the suction surface to a sheet conveyance path, a floating air blowing mechanism that blows floating air against the sheet from the side of sheets stacked on the sheet stacking table, a sheet position detecting sensor that detects an upper surface position of sheets stacked on the sheet stacking table and detects the state of floating of the sheet floated by the aforesaid floating air, and a controller that judges the state of floating of the sheet based on the state of detection of the sheet position detecting sensor during the floating state detecting period that interlocks with blowing out of the aforesaid floating air, and controls an air volume of floating air blown out of the floating air blowing mechanism based on the floating state of the sheet.

The third aspect is an image forming apparatus equipped with an image forming section that forms an image on a sheet, a sheet feeding device that feeds a sheet to an image forming section and a controller that feeds a sheet to the image forming section from the sheet feeding device, and controls forming of the image in the image forming section, wherein the sheet feeding device has therein a sheet stacking table that has thereon plural stacked sheets and goes up and down in the direction of sheet stacking, a sucking and conveying mechanism that sucks sheets stacked on the sheet stacking table from the upper surface, then, sucks the uppermost sheet on a suction surface and conveys the sheet sucked on the suction surface to a sheet conveyance path, a floating air blowing mechanism that blows floating air from the side of sheets stacked on the sheet stacking table and a sheet position detecting sensor that detects a position of an upper surface of sheets stacked on the sheet stacking table and detects the state of floating of the sheet floated by the aforesaid floating air, and the controller judges the state of floating of the sheet by the state of detection of the sheet position detecting sensor during a period of detection of the state of floating that is interlocked with blowing out of the aforesaid floating air, and controls an air volume of floating air blown out from a floating air blowing mechanism based on the state of floating of the sheet.

BRIEF DESCRIPTION OF THE DRAWINGS

FIG. 6 is an illustration showing an example of detection state table Tb2.

DETAILED DESCRIPTION OF THE PREFERRED EMBODIMENT

Figure 1:
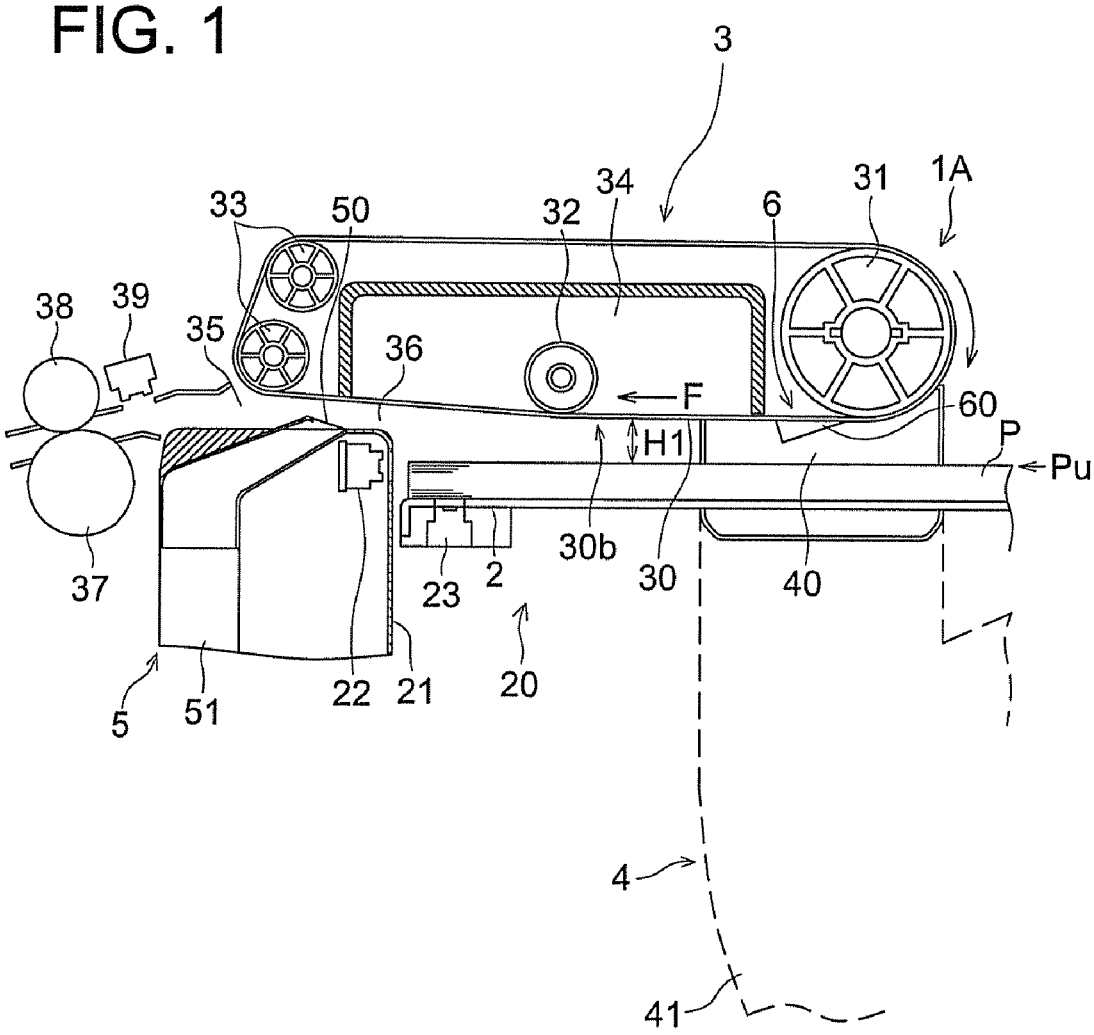
FIG. 1 is a side view showing an example of a sheet feeding device of the present embodiment.

Embodiments for the sheet feeding device of the invention, the sheet feeding unit equipped with the sheet feeding device and for the image forming apparatus to which the sheet feeding unit is connected, will be explained as follows, referring to the drawings.

<Example of Construction for the Present Embodiment>

Figure 2:
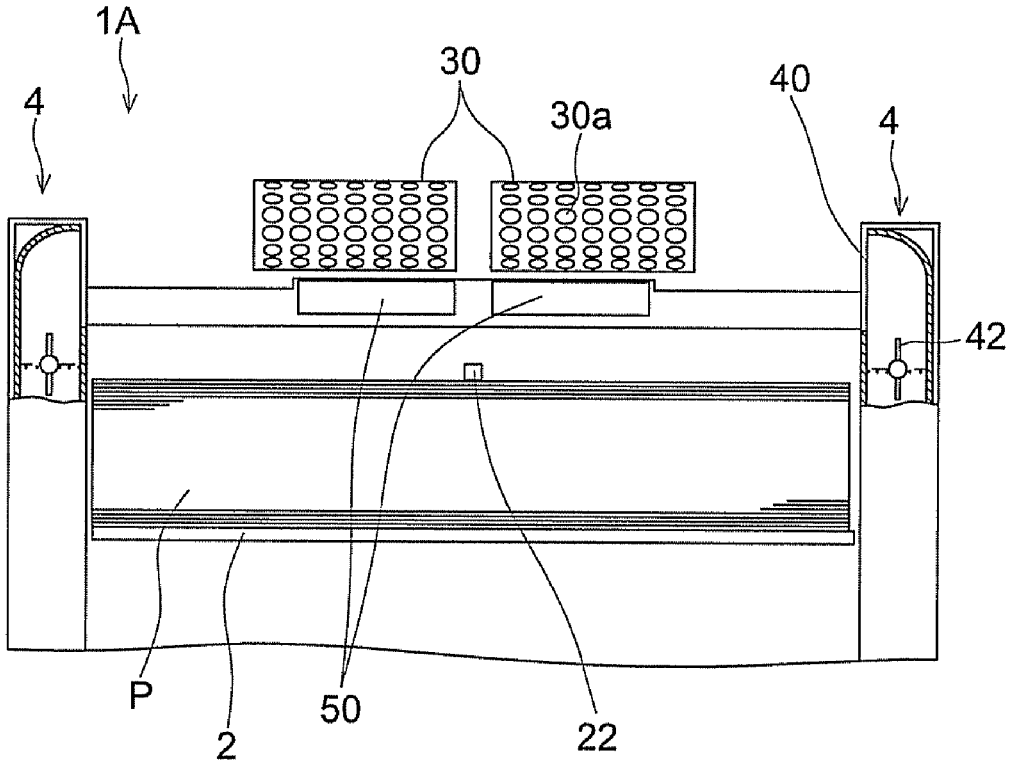
FIG. 2 is a front view showing an example of a sheet feeding device of the present embodiment.
Figure 3:
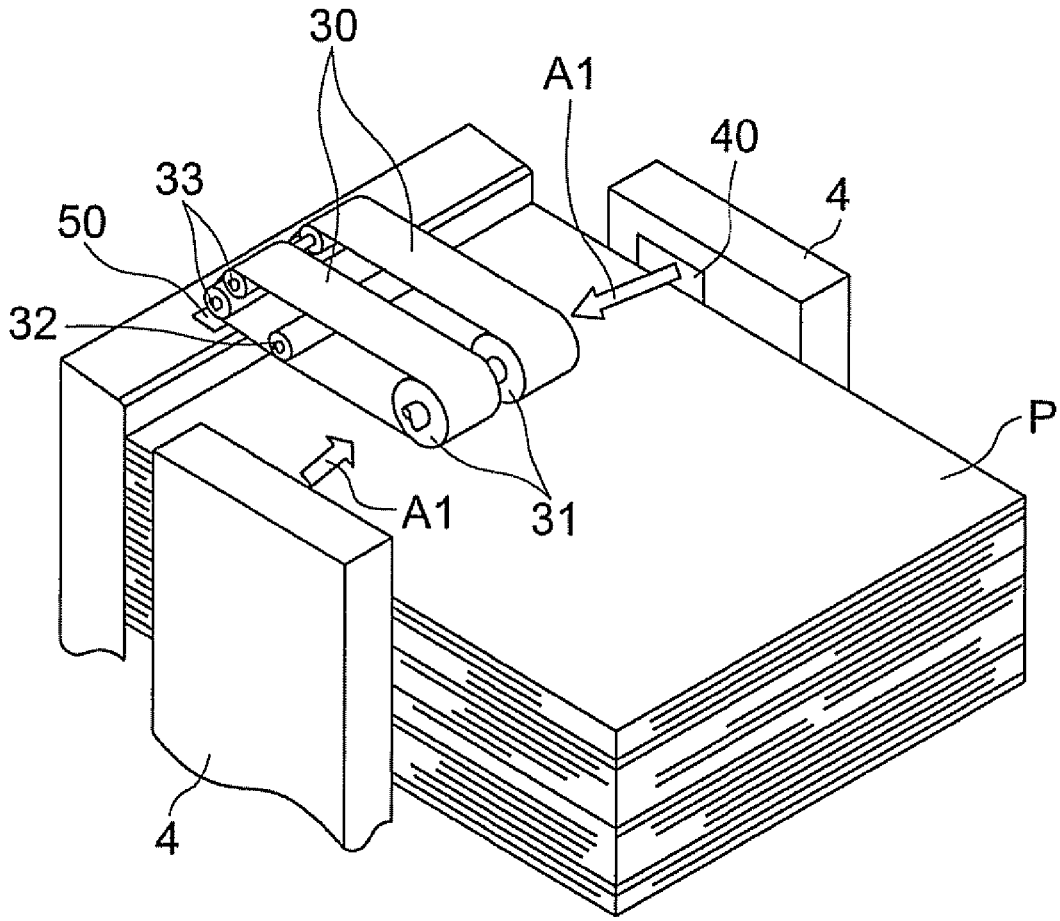
FIG. 3 is a perspective view of a sheet storage section showing an example of a sheet feeding device of the present embodiment.

FIG. 1 is a side view showing an example of a sheet feeding device of the present embodiment, FIG. 2 is a front view showing an example of a sheet feeding device of the present embodiment and FIG. 3 is a perspective view of a sheet storage section showing an example of a sheet feeding device of the present embodiment.

The sheet feeding device 1A of the present embodiment is equipped with sucking and conveying mechanism 3 that sucks sheet P stacked on sheet stacking table 2 and feeds out and with floating air blowing mechanism 4 that blows floating air A1 against sheet P stacked on the sheet stacking table 2. Further, the sheet feeding device 1A is equipped with separation air blowing mechanism 5 that blows separation air A2 against sheet P sucked by sucking and conveying mechanism 3 from the front portion for the conveyance direction shown with arrow F for sheet P.

The sheet feeding device 1A blows out floating air A1 from floating air blowing mechanism 4, so that the state of sheet P floated by floating air A1 can be detected by the operation to float sheet P stacked on the sheet stacking table 2, and thereby controls so that floating air A1 may be blown out at appropriate air volume.

Details of sheet feeding device 1A of the present embodiment will be explained as follows. In the sheet feeding device 1A, sheet stacking table 2 is provided on sheet storage section 20 on which a space capable of storing sheets to be in a form where a prescribed number of sheets P are stacked is formed.

The sheet stacking table 2 is caused by an unillustrated rise and fall mechanism to go up and down in the direction of stacking of sheets P. Sheet leading edge stopper surface 21 that regulates a position of the leading edge of sheet P stacked on sheet stacking table 2 is formed on the sheet storage section 20 in the direction of going up and down of sheet stacking table 2.

Sheet feeding device 1A is equipped with sheet position detection sensor 22 that detects upper surface position Pu of sheet P stacked on sheet stacking table 2 and detects the state of sheet P floated by floating air A1. The sheet position detection sensor 22 is composed of a pair of optical sensors, for example, whose detection position is formed, in the stacking direction of sheet P, at a prescribed position of sheet leading edge stopper surface 21, and is arranged at a position for detecting that upper surface position Pu of sheet P stacked on the sheet stacking table 2 is at suction possibility height H1 by sucking and conveying mechanism 3. With respect to sheet position detection sensor 22, its output, for example, is OFF under the condition where sheet P is absent at suction possibility height H1, and its output is ON under the condition where sheet P is present at suction possibility height H1.

In the operations to float sheet P stacked on sheet stacking table 2 by blowing out floating air A1 from floating air blowing mechanism 4, an output (ON/OFF) of sheet position detection sensor 22 is changed during a prescribed period of time from the start of blowing out of floating air A1. For example, after blowing out of floating air A1 is started, a plurality of sheets P are floated, and an output of the sheet position detection sensor 22 is changed from ON to OFF. Among plural sheets P floated by floating air A1, those other than the uppermost sheet P sucked by sucking and conveying mechanism 3 are stacked again on the sheet stacking table 2, and an output of the sheet position detection sensor 22 is changed from OFF to ON.

Timing for output of the sheet position detection sensor 22 to change to ON and OFF during the prescribed period of time from the start of blowing out of floating air A1 is varied depending on a sheet type and a sheet thickness of sheet P. Owing to this, the state of sheet P floated by floating air A1 is detected from timing of ON/OFF of the sheet position detection sensor 22.

When a height of stacked sheets P on the sheet stacking table 2 is reduced by feeding out of sheets P stacked on the sheet stacking table 2 conducted by sucking and conveying mechanism 3, sheet feeding device 1A causes the sheet stacking table 2 to rise to the position where upper surface position Pu of sheet P is detected by the sheet position detection sensor 22, and upper surface position Pu of stacked sheets P on the sheet stacking table 2 is controlled to reach the suction possibility height H1.

The sheet feeding device 1A is equipped with sheet sensor 23 that detects presence or absence of sheep P stacked on the sheet stacking table 2. The sheet sensor 23 is composed, for example, of a pair of optical sensors to be mounted on the sheet stacking table 2, and its output is changed depending on presence or absence of sheet P on the sheet stacking table 2. When sheet P is absent on the sheet stacking table 2, an output of the sheet sensor 23, for example, is OFF, while, when sheet P is present on the sheet stacking table 2, an output is ON.

Sucking and conveying mechanism 3 is equipped with conveyance belt 30 on the upper portion of sheet storing section 20. Further, the sucking and conveying mechanism 3 is equipped with drive roller 31 on which the conveyance belt 30 is wound around, first driven roller 32 and second driven roller group 33 having two driven rollers.

The conveyance belt 30 is endless, and suction openings 30*a* each passing through the conveyance belt 30 are arranged in a row in the lateral direction of the conveyance belt 30, and plural suction openings 30*a* arranged in a row in the lateral direction of the conveyance belt 30 are formed repeatedly on the total area in the longitudinal direction of the conveyance belt 30.

The drive roller 31 has a shaft in the direction perpendicular to the conveyance direction shown with arrow F for sheet P, and is driven to be rotated by a motor which will be explained later. Each of the first driven roller 32 and second driven roller group 33 has a shaft that is in parallel with the shaft of the drive roller 31, and it is of the structure of free rotation driven by rotation of the conveyance belt 30 that is caused when the drive roller 31 is driven to rotate.

In sucking and conveying mechanism 3, second driven roller group 33 is arranged to be more front side than sheet leading edge hitting surface 21 is, for the conveyance direction for sheet P shown with arrow F. Further, the drive roller 31 is arranged on the upper portion of sheet stacking table 2. Further, first driven roller 32 is arranged on the upper portion of the sheet stacking table 2 between second driven roller group 33 and drive roller 31.

With respect to the sucking and conveying mechanism 3, the conveyance belt 30 is spread to be in parallel with the conveyance direction for sheet P between drive roller 31 and second driven roller group 33. Owing to this, a trailing edge side wound around drive roller 31 of the conveyance belt 30 is positioned at the upper part of sheet P stacked on sheet stacking table 2, while, a leading edge side wound around second driven roller 33 of the conveyance belt 30 is positioned to be more front side than sheet leading edge stopper surface 21 is. Further, on the sucking and conveying mechanism 3, two conveyance belts 30 are caused to stand in a row at left and right for the conveyance direction for sheet P.

Then, when the drive roller 31 is driven to rotate in the direction shown with an arrow, each conveyance belt 30 rotates, and the side of the conveyance belt 30 facing the sheet stacking table 2 moves in the conveyance direction for sheet P shown with arrow F.

The sucking and conveying mechanism 3 is composed so that a lower end position on a circumferential surface of the drive roller 31 and a lower end position on a circumferential surface of the first driven roller 32 may be almost the same in terms of a height. In contrast to this, a lower end position in a circumferential surface of the driven roller on the lower side among the second driven roller group 33 is composed to be higher than a lower end position of the first driven roller 32 by a prescribed amount.

Due to this, the sucking and conveying mechanism 3 is almost in parallel with a surface of sheet P stacked on sheet stacking table 2, between drive roller 31 and first driven roller 32, on the side facing the sheet stacking table 2 of the conveyance belt 30. In contrast to this, the sucking and conveying mechanism 3 is inclined upward along the conveyance direction for sheet P, between the first driven roller 32 and the second driven roller group 33, and the conveyance belt 30 takes a curved form on the portion where the conveyance belt is wound around the first driven roller 32.

The sucking and conveying mechanism 3 is equipped with suction chamber 34 into which air that sucks sheet P on conveyance belt 30 is sucked. With respect to the suction chamber 34, a space into which air is sucked by an unillustrated fan is formed inside the conveyance belt 30, then, the lower side facing the conveyance belt 30 positioned at the side facing sheet stacking table 2 is opened, and air is sucked in through suction opening 30*a* of the conveyance belt 30 on the side facing the sheet stacking table 2.

In the sucking and conveying mechanism 3, when air in the suction chamber 34 is sucked in by an unillustrated fan, pressure in the suction chamber 34 turns out to be negative, thus, air is sucked in through suction opening 30*a* of the conveyance belt 30 positioned on the side facing sheet stacking table 2, and a flow of air that sucks sheet P on the conveyance belt 30 located at the side facing sheet stacking table 2 is generated.

Due to this, with respect to the sucking and conveying mechanism 3, suction surface 30*b* that sucks sheet P is formed by the conveyance belt 30 on the side facing the sheet stacking table 2 where air is drawn in suction chamber 34 from suction opening 30*a*.

Sheet feeding device 1A is equipped with sheet conveyance path 35 through which the sheet P fed out by the sucking and conveying mechanism 3 is conveyed. The sheet conveyance path 35 is equipped with a guide member that guides sheet P sucked and fed out by sucking and conveying mechanism 3 to be conveyed, and sheet entering inlet 36 through which the sheet P enters is formed between the conveyance belt 30 on the side facing the sheet stacking table 2 and an upper end of sheet leading edge stopper surface 21.

In the sheet feeding device 1A, sheet conveyance path 35 is equipped with conveyance roller 37 and with driven roller 38 that faces the conveyance roller 37. The conveyance roller 37 is driven to rotate by the motor which will be explained later, and sheet P fed out by the sucking and conveying mechanism 3 is interposed by the conveyance roller 37 and the driven roller 38 to be conveyed.

In the sheet feeding device 1A, sheet conveyance path 35 has therein sheet detection sensor 39. The sheet detection sensor 39 is composed, for example, of a pair of optical sensors whose detecting place is formed at the upstream side of the conveyance roller 37 and the driven roller 38, and sheet P that is fed out by the sucking and conveying mechanism 3 and is conveyed by the conveyance roller 37 is detected. When a leading edge of sheet P fed out by the sucking and conveying mechanism 3 arrives at the sheet detection sensor 39, an output of the sheet detection sensor 39, for example, turns out to be ON, while, when a trailing edge of sheet P conveyed by the sucking and conveying mechanism 3 passes over the sheet detection sensor 39, an output turns out to be OFF.

In floating air blowing mechanism 4, floating air nozzle 40 is formed on the side of sheet storage section 20. The floating air blowing mechanism 4 blows out air sucked by air blowing fan 41 from floating air nozzle 40 as floating air A1, and blows floating air A1 against sheet P stacked on sheet stacking table 2 from the side way, to cause sheet P to be floated.

In the floating air blowing mechanism 4, shutter 42 that changes over presence or absence of blowing out of floating air A1 and air volume is driven by a solenoid which will be explained later, and the floating air nozzle 40 is opened and closed. In the floating air blowing mechanism 4, floating air A1 is blown out when floating air nozzle 40 is opened, and blowing out of floating air A1 is stopped when floating air nozzle 40 is closed.

Separation air blowing mechanism 5 is equipped with separation air nozzle 50 through which separation air A2 is blown out from sheet entering gate 36. In the separation air nozzle 50, air sucked in by air sending fan 51 is blown out obliquely against conveyance belt 30 toward sheet storage section 20. Separation air A2 blown out from the separation air nozzle 50 hits conveyance belt 30 obliquely, and is blown against sheet P from the front side of the sheet P sucked on suction surface 30*b* composed of the conveyance belt 30 on the side facing sheet stacking table 2.

Sheet feeding device 1A is equipped with suction detection sensor 6 that detects presence or absence of sheet P sucked on conveyance belt 30 by sucking and conveying mechanism 3. The suction detection sensor 6 detects presence or absence of adsorption of sheet P on conveyance belt 30, when detector 60 that is composed of conveyance belt 30 and is protruded from suction surface 30*b* composed of conveyance belt 30 is pressed by sheet P sucked on conveyance belt 30 and is displaced. With respect to the suction detection sensor 6, its output turns out to be OFF under the condition that sheet P is not sucked on conveyance belt 30, and its output turns out to be ON under the condition that sheet P is sucked on conveyance belt 30.

Figures 4, 5:
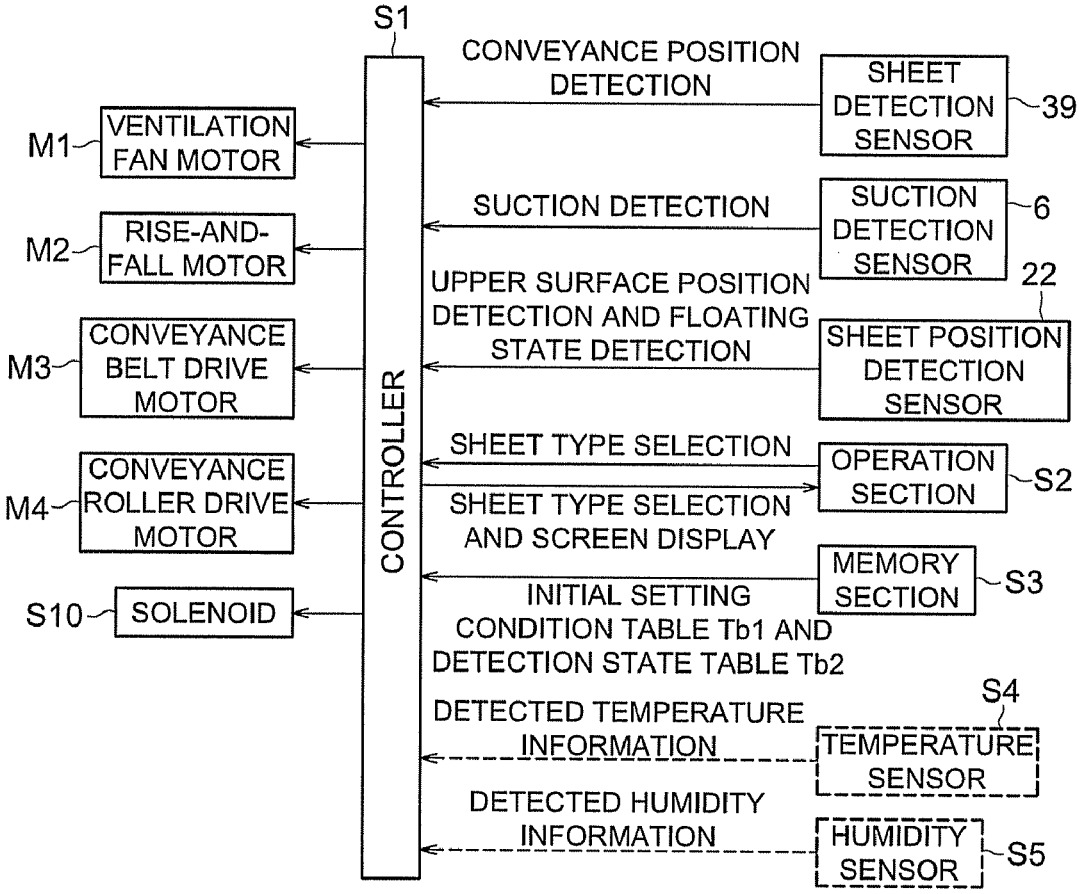
FIG. 4 is a functional block diagram showing an example of a control system of the sheet feeding device of the present embodiment.
FIG. 5 is an illustration showing an example of initial setting condition table Tb1.

FIG. 4 is a functional block diagram showing an example of a control system of the sheet feeding device of the present embodiment. The sheet feeding device 1A is equipped with controller S1 that conducts sheet feeding control to feed out sheets P stacked on sheet stacking table 2 one by one explained in FIG. 1, based on output of each sensor and with operation section S2 wherein sheet types such as a basis weight or the like are selected.

The controller S1 detects that sheet P is sucked on conveyance belt 30 in sucking and conveying mechanism 3 shown in FIG. 1, from an output of suction detection sensor 6. Further, the controller S1 detects that a leading edge and a trailing edge of sheet P fed out by sucking and conveying mechanism 3 arrive respectively at their prescribed positions, from an output of sheet detection sensor 39.

The controller S1 changes over presence or absence of blowing out of floating air A1 by floating air blowing mechanism 4 explained in FIG. 1, based on a position of conveyance of sheet P detected by sheet detection sensor 39 and on presence or absence of suction of sheet P on conveyance belt 30 detected by suction detection sensor 6. In the floating air blowing mechanism 4, shutter 42 that opens and closes floating air nozzle 40 is driven by solenoid S10, and presence or absence of blowing out of floating air A1 is changed over.

The controller S1 detects the state of floating of sheet P floated by floating air A1 from an output of sheet position detecting sensor 22, during the floating state detecting period that is interlocked with blowing out of floating air A1. The controller S1 changes over air volume of floating air A1, based on types of sheet P selected in operation section 52 and on the state of floating of sheet P detected by sheet position detecting sensor 22. In the floating air blowing mechanism 4, air volume of floating air A1 is changed over, when motor M1 that drives air blowing fan 41 is controlled and the number of revolution per minute of the air blowing fan 41 is changed. Further, air volume of floating air A1 can be changed over by divergencies and opening and closing of shutter 42 that opens and closes floating air nozzle 40.

The controller S1 detects a position of an upper surface of sheet P stacked on sheet stacking table 2 from an output of sheet position detecting sensor 22, during the detecting period for sheet height that is interlocked with a stop of blowing out of floating air A1. The controller S1 controls motor M2 that causes sheet stacking table 2 to go up and down based on the position of an upper surface of sheet P detected by the sheet position detecting sensor 22, to make the position Pu of an upper surface of sheet P stacked on the sheet stacking table 2 to be equal to sheet feeding possibility height H1.

The controller S1 controls motor M3 that drives conveyance belt 30 and motor M4 that drives conveyance roller 37, based on presence or absence of suction of sheet P on conveyance belt 30 detected by suction detecting sensor 6 and on a conveyance position of sheet P detected by sheet feeding detecting sensor 39.

Incidentally, sheet feeding device 1A may possess either one of temperature sensor S4 and humidity sensor S5, or may possess both of them, as an environmental detecting section. The temperature sensor S4 and the humidity sensor S5 detect respectively temperature and humidity in surroundings of the sheet feeding device 1A, or in sheet storage section 20. Further, the controller S1 controls a motor that drives an air sending fan of sucking and conveying mechanism 3 and a motor that drives an air sending fan 51 of separation air blowing mechanism 5, which is not shown in FIG. 4. In this case, the controller S1 may also be constituted of a controller of an image forming apparatus which will be explained later.

The controller S1 judges whether the state of floating of sheet P detected by timing of ON/OFF of sheet position detecting sensor 22 is appropriate or not. Namely, with respect to the controller S1, reference air volume information for blowing out floating air A1 at an air volume conforming to sheet types such as basis weight of sheet P is established in advance. Further, there is established floating state reference value information showing the state of floating that is to be detected by the sheet position detecting sensor 22 when floating air A1 is blown out at air volume based on reference air volume information that is specified by sheet types of sheet P.

The controller S1 compares floating state detecting information detected by an output of sheet position detecting sensor 22 with floating state reference value information established in advance based on sheet types of sheet P, to judge whether the state of floating of sheet P is proper or not.

FIG. 5 is an illustration showing an example of initial setting condition table Tb1 on which reference air volume information is established. In the initial setting condition table Tb1, there is established basis weight of sheet P as sheet type information of sheet P, which is stored in memory section S3. Further, as reference air volume information, there is established the number of revolutions per minute of a fan of air sending fan 41 for blowing out floating air A1 at air volume corresponding to basis weight of sheet P.

After the basis weight is selected as a sheet type of sheet P in operation section S2, the controller S1 establishes the number of revolutions per minute of a fan corresponding to the selected basis weight of sheet P, referring to the initial setting condition table Tb1 stored in the memory section S3.

FIG. 6 is an illustration showing an example of detection state table Tb2 where floating state reference value information is established. On the detection state table Tb2, there is established basis weight of sheet P as type information of sheet P, and the basis weight is stored in storing section S3. Further, as floating state reference value information, there are established the number of times of OFF/ON for an output of sheet position detecting sensor 22 corresponding to basis weight of sheet P and a reference value of a period of time during which an output of sheet position detecting sensor 22 stays to be ON.

The controller S1 refers to the detection state table Tb2 stored in memory section S3 to compare floating state detection information for sheet P detected by sheet position detecting sensor 22 during the floating state detecting period that is interlocked with blowing out of floating air A1 with floating state reference value information corresponding to basis weight of sheet P established in advance.

As a result, the controller S1 judges that the floating state in the case of floating sheet P with floating air A1 at air volume established in accordance with basis weight of sheet P is appropriate, if the floating state detection information detected during the floating state detecting period is equal to the floating state reference value information.

In contrast to this, the controller S1 judges that the floating state in the case of floating sheet P with floating air A1 at air volume established in accordance with basis weight of sheet P is not appropriate, if the floating state detection information detected during the floating state detecting period is different from the floating state reference value information.

During the floating state detecting period that is interlocked with blowing out of floating air A1, sheet P on sheet stacking table 2 is floated by floating air A1. With respect to detection of floating state by sheet position detecting sensor 22, OFF/ON takes place within a given period of time, if sheet P is floated appropriately, because a surface of a leading edge of sheet P is detected.

With respect to the number of times of OFF/ON for sheet position detecting sensor 22, its reference value is in a range from one to several times for one sheet of sheet P to be fed, under the cycle to feed sheets one by one by floating sheet P. Under the conditions where the number of times of OFF/ON of sheet position detecting sensor 22 is large, an output is ON constantly and a period of time for OFF is long, an air volume of floating air A1 is changed because the state of floating is not appropriate.

In general, when air volume of floating air A1 is large, sheet P tends to behave violently, and the number of times of OFF/ON for an output of sheet position detecting sensor 22 grows greater, in the case of thin paper. In the case of thick paper, an output of sheet position detecting sensor 22 stays to be ON for a long time and is not changed to OFF, because sheets P are floated in a form of a bundle if air volume of floating air A1 is large. If air volume of floating air A1 is small in the case of thick paper, an output of sheet position detecting sensor 22 stays to be OFF for a long time. Based on these conditions mentioned above, floating state reference value information is established for detection state table Tb2.

<An Example of Operations for Sheet Feeding Device in the Present Embodiment>

Figure 7:
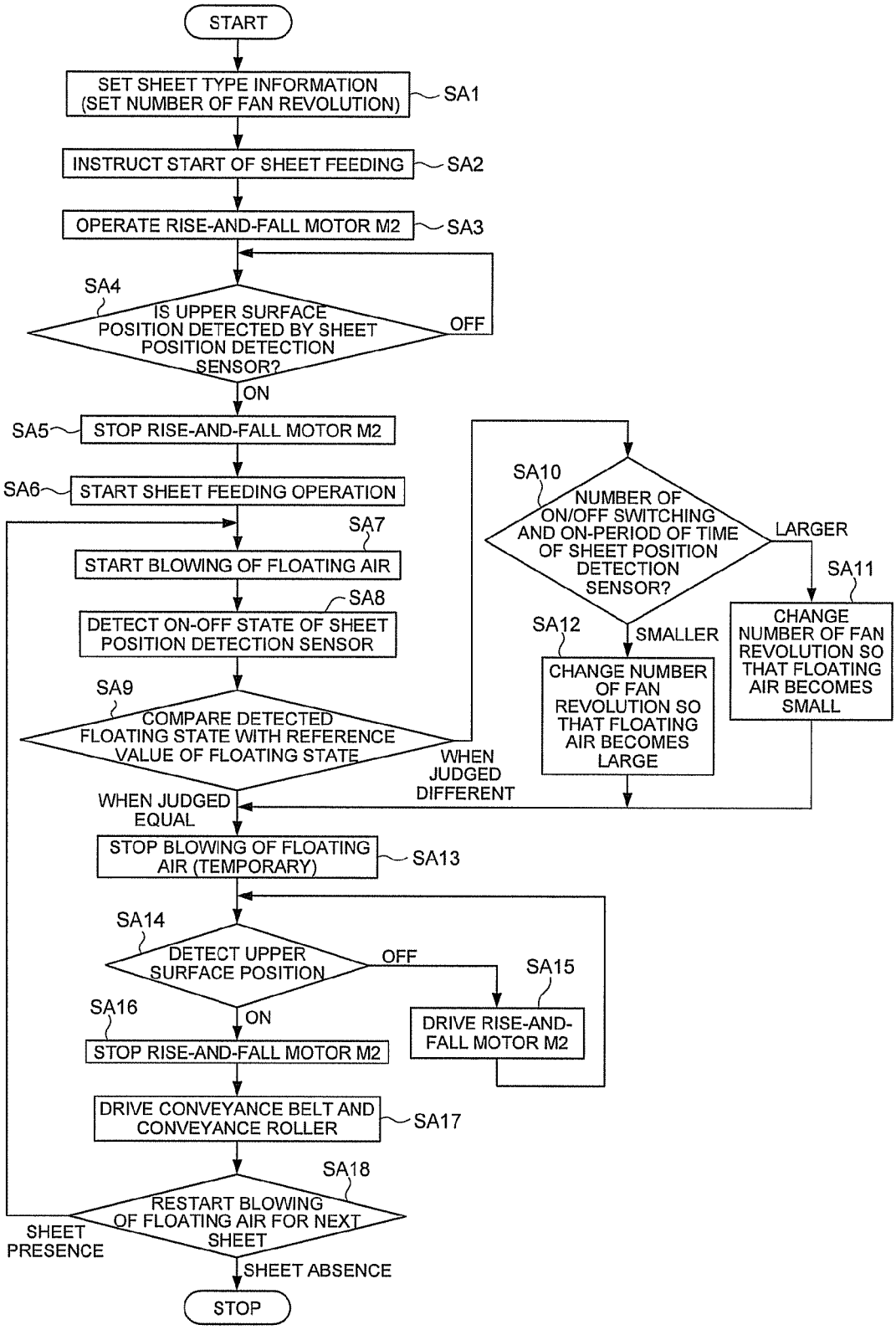
FIG. 7 is a flow chart showing an example of operations of a sheet feeding device of the present embodiment.
Figure 8:
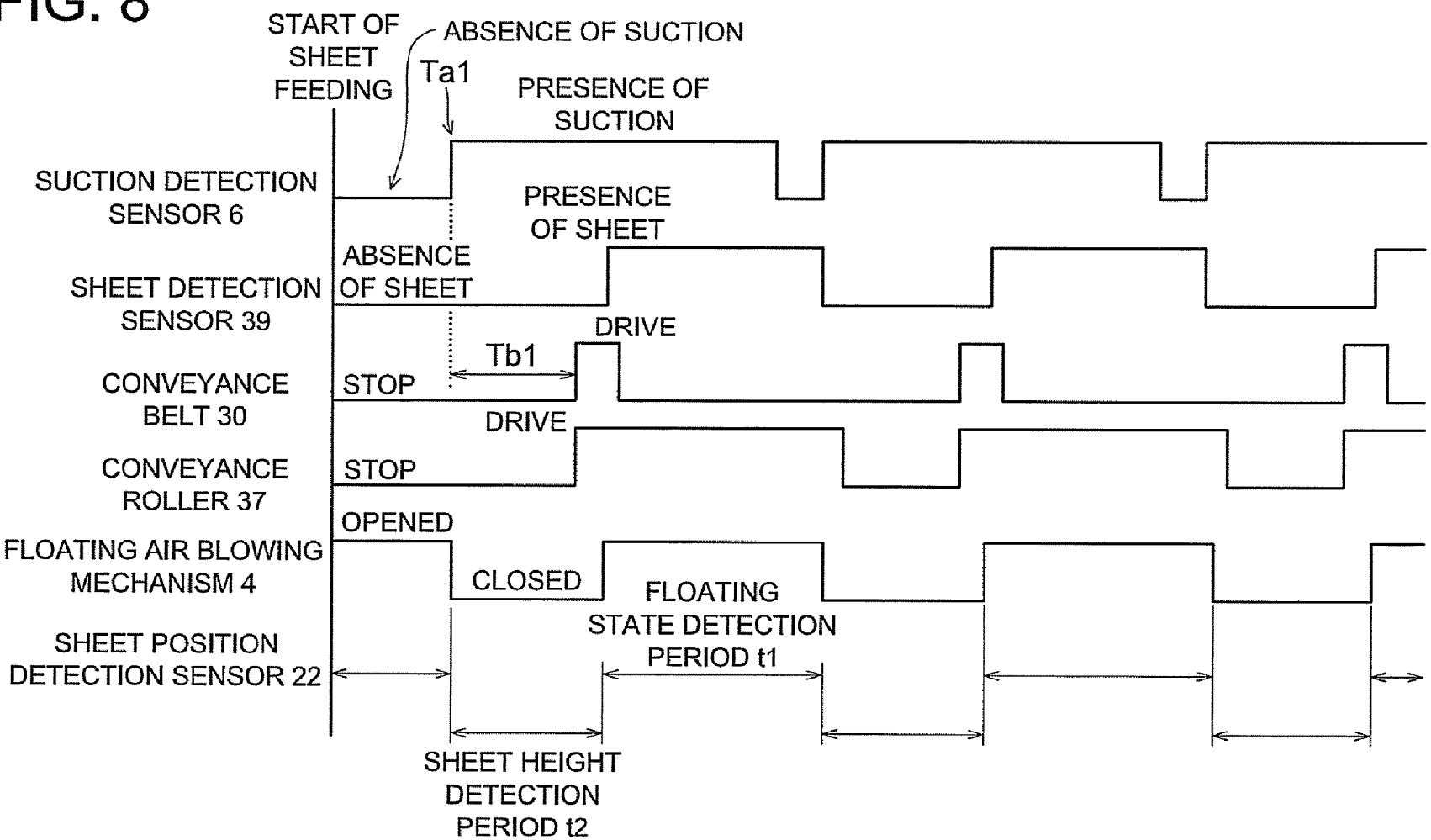
FIG. 8 is a time chart showing an example of operations of a sheet feeding device of the present embodiment.

FIG. 7 is a flow chart showing an example of operations of a sheet feeding device of the present embodiment, while, FIG. 8 is a time chart showing an example of operations of a sheet feeding device of the present embodiment, and an example of operations of sheet feeding device 1A of the present embodiment will be explained next, referring to respective drawings.

In sheet feeding device 1A, a sheet type selection screen on which a sheet type of sheet P stacked on sheet stacking table 2 is selected is displayed, for example, on operation section S2. When basis weight is selected on the sheet type selection screen as a sheet type of sheet P stacked on sheet stacking table 2 in the present example, the controller S1 establishes the number of revolutions per minute of a fan for blowing out floating air A1 at air volume corresponding to basis weight of sheet P by referring to initial setting condition table Tb1 stored in memory section S3 in step SA1.

When a start of sheet feeding instruction is received in step SA2, the controller S1 controls motor M2 that causes sheet stacking table 2 to go up and down in step SA3, and judges whether upper surface position Pu of sheet P stacked on the sheet stacking table 2 has been made to be equal to suction possibility height H1 by sucking and conveying mechanism 3 or not based on an output of sheet position detecting sensor 22, in step SA4. Then, if the upper surface position Pu of sheet P has been made to be equal to the suction possibility height H1, motor M2 is stopped in step SA5 to stop ascent and descent of the sheet stacking table 2.

When sheet feeding operations are started in step SA6, the controller S1 controls motor M1 that drives air blowing fan 41 of floating air blowing mechanism 4, to blow out floating air A1 in step SA7. Further, air sending fan 51 of separation air blowing mechanism 5 is driven, and separation air A2 is blown out. In addition, an unillustrated fan in sucking and conveying mechanism 3 is driven to suck air from suction chamber 34. Owing to this, floating and suction operations for sheet P are carried out.

In the sucking and conveying mechanism 3, when air in the suction chamber 34 is sucked in by an unillustrated fan, pressure in the suction chamber 34 turns out to be negative, thus, air is sucked in through suction opening 30*a* of the conveyance belt 30 positioned on the side facing sheet stacking table 2, and a flow of air that sucks sheet P on the conveyance belt 30 located at the side facing sheet stacking table 2 is generated. Further, in floating air blowing mechanism 4, floating air A1 is blown from the side of sheet P stacked on sheet stacking table 2.

Due to this, in sheets P stacked on the sheet stacking table 2, sheets P stacked on the upper portion are floated, and uppermost sheet P stacked on the sheet stacking table 2 is sucked on conveyance belt 30 constituting suction surface 30*b*.

The controller S1 detects the number of times of OFF/ON for an output of sheet position detecting sensor 22 and a period of time during which an output of sheet position detecting sensor 22 is ON, during floating state detecting period t1 interlocked with blowing out of floating air A1, in step SA8.

The controller S1 compares floating state detection information for sheet P detected by sheet position detecting sensor 22 during floating state detecting period t1 with floating state reference value information corresponding to basis weight of sheet P established in advance, by referring to detection state table Tb2 stored in memory section S3, in step SA9.

If the floating state detection information detected during floating state detecting period t1 and the floating state reference value information are the same, the controller S1 judges that the floating state in the case of floating sheet P with floating air A1 at air volume established in accordance with basis weight of sheet P is appropriate.

If the floating state detection information detected during floating state detecting period t1 and the floating state reference value information are different from each other, the controller S1 judges that the floating state in the case of floating sheet P with floating air A1 at air volume established in accordance with basis weight of sheet P is not appropriate.

If the controller S1 judges that floating state detection information detected during floating state detecting period t1 and floating state reference value information are different from each other in step SA9, the controller S1 judges, in step SA10, whether the number of times of OFF/ON for an output of sheet position detecting sensor 22 and a period of time during which an output of the sheet position detecting sensor 22 is ON are greater or smaller than floating state reference value information, in step SA10.

If the controller S1 judges that the number of times of OFF/ON for an output of sheet position detecting sensor 22 and a period of time during which an output of the sheet position detecting sensor 22 is ON are greater than the floating state reference value information, in step SA10, the controller S1 establishes the number of revolutions per minute of a fan so that air volume for floating air A1 may be reduced, in step SA11.

If the controller S1 judges that the number of times of OFF/ON for an output of sheet position detecting sensor 22 and a period of time during which an output of the sheet position detecting sensor 22 is ON are smaller than the floating state reference value information, in step SA10, the controller S1 establishes the number of revolutions per minute of a fan so that air volume for floating air A1 may be increased, in step SA12.

For establishment of the number of revolutions per minute of a fan, it is also possible to control the number of revolutions per minute of motor M1 that drives air blowing fan 41 of floating air blowing mechanism 4. It is further possible to arrange so that air volume can be adjusted by divergencies and opening and closing of shutter 42 that opens and closes floating air nozzle 40. Namely, responsiveness for opening and closing of shutter 42 by solenoid S10 is high for control signals. Therefore, when air volume of floating air A1 is controlled based on floating state detection information, it is possible to acquire the targeted air volume more rapidly, in comparison with an occasion of continuous sheet feeding. Due to this, it is possible to cause a change of air volume to follow continuous sheet feeding, even when changing air volume of floating air A1 on the half way of continuous sheet feeding.

In this case, if a residue of sheets P stacked on sheet stacking table 2 is different, there is a difference in terms of the state of floating of sheet P when floating air A1 is blown under the same air volume. Therefore, the controller S1 detects a residue of sheets P stacked on sheet stacking table 2, based on a height of the sheet stacking table 2 and on the number of fed sheets. Then, it is also possible to correct the floating state reference value information based on a residue of sheets P to judge whether the state of floating of a sheet is appropriate or not.

Further, if temperature and humidity in a place where sheet feeding device 1A is installed are changed, the state of floating for sheet P is varied even when floating air A1 is blown under the same air volume. Therefore, the controller S1 detects temperature and humidity based on outputs of temperature sensor S4 and humidity sensor S5. Then, it is also possible to judge whether the state of floating for a sheet is appropriate or not, by correcting the floating state reference value information based on the temperature and humidity.

After detecting that sheet P has been sucked on conveyance belt 30 based on output of suction detecting sensor 6 at timing Ta1, the controller S1 drives solenoid S10 to close floating air nozzle 40 and stops blowing out of floating air A1 from the floating air nozzle 40, in step SA13. Operations of sucking sheets P by sucking and conveying mechanism 3 are continued.

After the blowing out of floating air A1 has been stopped in step SA13, the controller S1 detects a position of an upper surface of sheet P stacked on sheet stacking table 2 based on an output of the sheet position detecting sensor 22 during sheet height detection period t2 interlocked with discontinuance of blowing out of floating air A1, in step SA14.

The controller S1 controls motor M2 that causes sheet stacking table 2 to go up and down, based on positions of an upper surface of sheet P obtained through detections by sheet position detecting sensor 22 in steps SA15 and SA16, and causes upper position Pu of sheet P stacked on sheet stacking table 2 to be equal to sheet feeding possibility height H1.

Conveyance belt 30 positioned on the side facing sheet stacking table 2 takes a curved shape on the portion where the conveyance belt is wound around the first driven roller 32, and the conveyance belt 30 positioned between the first driven roller 32 and the second driven roller group 33 is inclined upward in the direction of conveyance of sheet P. Owing to this, sheet P sucked on the conveyance belt 30 takes a curved shape at the portion where the conveyance belt 30 is wound around the first driven roller 32.

When two or more sheets P are sucked to the conveyance belt 30 by sucking and conveying mechanism 3, plural sheets P are in the state wherein the plural sheets P stick to each other. Due to this, one uppermost sheet P sucked on the conveyance belt 30 takes a curved shape, following the portion where the conveyance belt 30 is wound around the first driven roller 32, because suction force of suction air directly applies on the uppermost sheet.

In contrast to this, suction force by suction air does not apply directly on the second sheet and thereafter each sticks to the uppermost sheet P and is sucked by the sucking and conveying mechanism 3. Owing to this, the second sheet P and thereafter do not follow the curved shape of the conveyance belt 30 in the portion where the conveyance belt is wound around the first driven roller 32, thus, clearances are generated between the one uppermost sheet P and the second sheet P and thereafter, and the sheets are separated.

In separation air blowing mechanism 5, when air sending fan 51 is driven, air sucked in by air sending fan 51 is blown out from separation air nozzle 50. Separation air A2 blown out of separation air nozzle is oriented to be in parallel with the direction of the conveyance belt 30 on the side facing sheet stacking table 2, to be blown against sheet P in the direction that is almost horizontal, from the front of sheet P sucked on conveyance belt 30 on the side facing the sheet stacking table 2, in the sucking and conveying mechanism 3.

When two or more sheets P are sucked on conveyance belt 30 in sucking and conveying mechanism 3, a clearance is generated between the leading edge surface of the first one uppermost sheet P1 and the leading edge surface of the second sheet P2 and thereafter as described above. Due to this, separation air A2 blown out against sheet P in the mostly horizontal direction from separation air blowing mechanism 5 is blown against a space between the uppermost one sheet P sucked on conveyance belt 30 and the second sheet P and thereafter.

On the uppermost one sheet P sucked on conveyance belt 30, suction force by suction air for conveyance belt 30 operates, and it remains in the state where the force is sucked in conveyance belt 30. On the other hand, second sheet P and thereafter sucked on conveyance belt 30 while following the first sheet P are separated by separation air A2.

When a prescribed separation standing by period of time tb1 has passed after sheet P is sucked on conveyance belt 30 in sucking and conveying mechanism 3, the controller S1 causes motor M3 to drive roller 31 of sucking and conveying mechanism 3 to rotate in step SA17, and causes motor M4 to drive conveyance roller 37 to rotate, to start sheet feeding operations.

When the drive roller 31 is driven to rotate in the direction shown with an arrow, the conveyance belt 30 is rotated, and the side of the conveyance belt 30 facing the sheet stacking table 2 moves in the direction shown with arrow F. Due to this, sheet P sucked on conveyance belt 30 by sucking and conveying mechanism 3 is fed out in the conveyance direction shown with arrow F, in sucking and conveying mechanism 3.

When sucked sheet P is fed out by conveyance belt 30 in sucking and conveying mechanism 3, a leading edge of sheet P thus fed out is detected by sheet feeding detection sensor 39, and sheet P fed out is interposed by conveyance roller 37 and by driven roller 38.

When the controller S1 detects that a leading edge of the first sheet P fed out by conveyance belt 30 has arrived at conveyance roller 37, floating air nozzle 40 is opened and flowing out of floating air A1 is started again by the controller S1, in step SA18, when sheet feeding is continuous. When flowing out of floating air A1 is started again, detection of the state of floating of sheet P and control of air volume of floating air A1 corresponding to the state of floating are conducted during floating state detecting period t1.

When prescribed standby time established by considering a period of time up to the moment when sheet P is interposed by conveyance roller 37 and driven roller 38 has passed after arrival of a leading edge of sheet P fed out by conveyance belt 30 at sheet detection sensor 39 was detected, the controller S1 stops drive for rotation by drive roller 31. On the other hand, drive for rotation by conveyance roller 37 is continued.

Due to this, first sheet P interposed by conveyance roller 37 and driven roller 38 is conveyed. Meanwhile, in sheet feeding operations for sheet P, suction operation for sheet P by sucking and conveying mechanism 3 is continued, and thereby, force to attract sheet P on conveyance belt 30 is acting. However, conveying force by interposing between the conveyance roller 37 and the driven roller 38 is stronger than suction force, whereby, sheet P is drawn out under the condition that conveyance belt 30 is stopped.

When the first sheet P interposed between the conveyance roller 37 and the driven roller 38 is conveyed, second sheet P is sucked on conveyance belt 30 in the case of continuous sheet feeding, and the same control as that in the first sheet P is conducted thereafter.

<Construction Examples of Image Forming Apparatus and Sheet Feeding Unit in the Present Embodiment>

Figure 9:
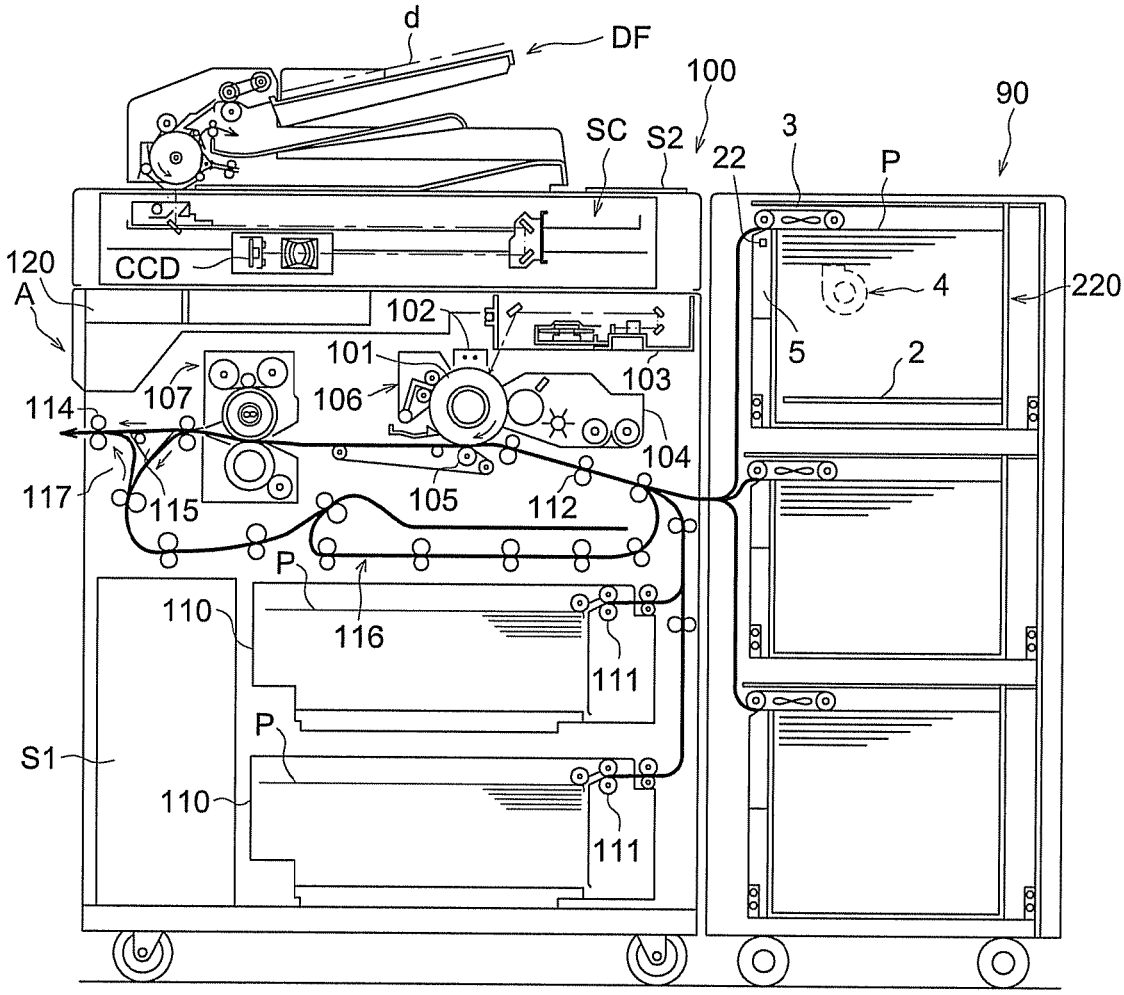
FIG. 9 is a structural diagram showing an example of an image forming apparatus and a sheet feeding device equipped with a sheet feeding unit of the present embodiment.

FIG. 9 is a structural diagram showing examples of a sheet feeding unit and an image forming apparatus each being equipped with a sheet feeding device of the present embodiment. Image forming apparatus 100 is equipped with image forming apparatus main body A, image reading unit SC, automatic document feeding unit DF and large capacity sheet feeding unit 90.

Sheet feeding unit 90 is equipped with a plurality of sheet trays constituting sheet storage section 20 shown in FIG. 1, and in the present example, the sheet feeding unit 90 is equipped with three sheet trays 220 which are provided in the vertical direction. Each sheet tray 220 is equipped with sheet position detecting sensor 22 that detects a position of an upper surface and the state of floating of sheet P stacked on sheet stacking table 2 that constitutes sheet feeding device 1A of the present embodiment. Further, each sheet tray 220 is equipped with sucking and conveying mechanism 3 having conveyance belt 30 shown in FIG. 1 or the like.

Further, there are provided floating air blowing mechanism 4 that blows floating air from the side of sheet P stacked on sheet tray 220 and separation air blowing mechanism 5 that blows separation air against a space between the uppermost one sheet and the second sheet and thereafter when two or more sheets P are sucked by sucking and conveying mechanism 3.

Image forming apparatus main body A is equipped with an image forming section having therein photoconductor 101 representing an image carrier, charging section 102, exposure unit 103, developing unit 104, transfer section 105 and cleaning section 106 and with a fixing device 107 and a sheet conveyance section. The image forming apparatus main body A is further equipped with controller S1 that controls image forming apparatus 100 and with operation section S2 where various operations are carried out.

The sheet conveyance section is composed of sheet feeding tray 110, first sheet feeding section 111, second sheet feeding section 112, sheet ejection section 114, conveyance path switching section 115, circulation sheet re-feeding section 116 and reversing ejection section 117. In this case, the sheet feeding tray 110 may also be equipped with sucking and conveying mechanism 3, floating air blowing mechanism 4, separation air blowing mechanism 5 and sheet position detection sensor 22, which constitute sheet feeding device 1A of the present embodiment.

Document "d" placed on a document platen of automatic document feeder DF is conveyed by a sheet feeding section, and images on one side or on both sides of document "d" are given exposure by an optical system of image reading device SC, so that the images are read in by image sensor CCD. Analog signals obtained through photoelectric conversion by image sensor CCD are subjected to analog processing, A/D conversion, shading correction and image compression processing in image processing section 120, and then, image signals are sent to exposure unit 103.

In the image forming section, there are conducted processes for charging, exposure, development, separation and cleaning. In the image forming section, a surface of photoconductor 101 is electrified by charging section 102, and an electrostatic latent image is formed on the surface of photoconductor 101 by illumination of a laser beam coming from exposure unit 103, and the electrostatic latent image is visualized by developing unit 104 to become a toner image. Then, the sheet P stored in sheet feeding tray 110 is conveyed from the first sheet feeding section 111. Or, sheet P stored in sheet feeding unit 90 is conveyed from sucking and conveying mechanism 3. The sheet P is synchronized with the toner image in the second sheet feeding section 112 composed of a registration roller, to be conveyed. After that, the toner image is transferred onto the sheet P in transfer section 105, and is fixed by fixing device 107.

The sheet P after being subjected to fixing is ejected out of the apparatus by sheet ejection section 114. On the other hand, toner staying on photoconductor 101 after transfer is removed by cleaning section 106. Meanwhile, in the case of duplex copying, sheet P which has undergone image forming on its first surface is sent in circulation sheet re-feeding section 116 to be reversed to undergo image forming again on its second surface in the image forming section, and is ejected out of the apparatus by the sheet ejection section 114. In the case of reverse sheet ejection, sheet P which has branched off the ordinary sheet ejection path is ejected out of the apparatus by the sheet ejection section 114 after being reversed inside out through switchback in reverse sheet ejection section 117.

Incidentally, though an image forming apparatus has been one for forming a monochrome image in the foregoing, it may also be an image forming apparatus forming color images.

The present invention is applied on an image forming apparatus equipped with a sheet feeding device that feeds out stacked sheets by sucking a sheet with air.

In the sheet feeding device of the present embodiment, when floating a sheet by blowing floating air from the side of the sheet stacked on a sheet stacking table, it is possible to control air volume of floating air based on the state of floating of the sheet by detecting the state of floating of the sheet by a sheet position detecting sensor. Owing to this, it is possible to optimize air volume of floating air in accordance with the actual state of floating of the sheet, thus, the state of floating of a sheet by floating air can be stabilized, which makes sure separation and conveyance of a sheet to be possible. Further, it is possible to optimize air volume without being influenced by conditions peculiar to the sheet such as sheet types and by external conditions such as the state of storage of sheets and the state of stacking of sheets.

In the sheet feeding unit of the present embodiment, double feeding of sheets can be prevented surely by providing the aforesaid sheet feeding device. Further, in the image forming apparatus of the present embodiment, it is possible to prevent double feeding surely and to improve image quality by providing the aforesaid sheet feeding device.

What is claimed is:

1. A sheet feeding device comprising:

(a) a sheet stacking table that rises and falls in a sheet stacking direction, on which a plurality of sheets are stacked;

(b) a sucking and conveying mechanism having a suction surface, which sucks the sheets stacked on the sheet stacking table from an upper surface of the sheets, sucks an uppermost sheet to be sucked on the suction surface, and conveys the uppermost sheet sucked on the suction surface onto a sheet conveyance path;

(c) a floating air blowing mechanism which blows floating air against the sheets from a side surface of the stacked sheets when the sheet is fed from the sheet stacking table;

(d) a sheet position detecting sensor which detects an upper surface position in a vertical direction of the sheets stacked, and detects a floating state of the sheets floated by the floating air; and (e) a controller which judges the floating state of the sheets detected by the sheet position detection sensor in a predetermined finite floating state detecting period in connection with a blowing of the floating air, and controls an air volume of floating air blown from the floating air blowing mechanism based on the floating state of the sheets;

wherein the sheet position detecting sensor detects the floating state of the sheets based on a number of turning on-and-off operations thereof in the predetermined finite floating state detecting period;

wherein there is at least one off and one on operation thereof in the predetermined finite floating state detecting period.

2. The sheet feeding device of claim 1, wherein the controller compares the floating state of the sheets detected by the sheet position detecting sensor with a reference value of the floating state, and controls the air volume of the floating air blown from the floating air blowing mechanism based on the comparison result.

3. The sheet feeding device of claim 1, further comprising a memory which stores a reference value of the floating state, wherein the controller compares the floating state of the sheets detected by the sheet position detecting sensor in the predetermined finite floating state detecting period with the reference value of the floating state stored in the memory, judges whether the floating state is proper or not, and controls the air volume of the floating air based on the judgment result.

4. The sheet feeding device of claim 1, further comprising:

a sheet type information setting section which sets a type of the sheets stacked on the stacking table; and a memory which stores a floating state reference value in accordance with the type of the sheets, wherein the controller compares the floating state of the sheets detected by the sheet position detecting sensor during the predetermined finite floating state detecting period with a floating state reference value in accordance with the type of the sheets which has been preset by the sheet type information setting section that is selected from the floating state reference value stored in the memory, judges whether the floating state is proper or not, and controls the air volume of the floating air based on the judgment result.

5. The sheet feeding device of claim 4, wherein the memory stores reference air volume information by which floating air having air volume in accordance with the type of the sheets is blown, and the controller controls the floating air blowing mechanism by the reference air volume information in accordance with the type of the sheets which has been preset by the sheet type information setting section, and judges the floating state of the sheets detected by the sheet position detecting sensor during the floating state detecting period in connection with the blowing of the floating air having the air volume in accordance with the type of the sheets.

6. The sheet feeding device of claim 4, wherein the controller judges whether or not the floating state of the sheet detected by the sheet position detecting sensor in predetermined finite the floating state detecting period is proper with reference to the floating state reference value in accordance with the type of the sheet, and a residue of the sheets stacked on the sheet stacking table, and controls the air volume of the floating air based on the judgment result.

7. The sheet feeding device of claim 4, wherein the controller judges whether or not the floating state of the sheet detected by the sheet position detecting sensor in the predetermined finite floating state detecting period is proper with reference to the floating state reference value in accordance with the type of the sheet, and an environmental state detected by an environmental detecting section, and controls the air volume of the floating air based on the judgment result.

8. The sheet feeding device of claim 1, wherein the predetermined finite floating state detecting period in connection with a blowing of the floating air and a sheet height detection period in connection with a discontinuation of the blowing of the floating air are alternately set during each cycle to feed continuously sheets one by one stacked on the sheet stacking table, the controller compares the floating state of the sheets detected by the sheet position detecting sensor in each of the predetermined finite floating state detecting period with a floating state reference value in accordance with a type of the sheets that has been set by the sheet type information setting section which is selected from the floating state reference value stored in the memory section, judges whether the floating state of the sheets is proper or not, and controls the air volume of the floating air based on the judgment result.

9. The sheet feeding device of claim 8, wherein the floating air blowing mechanism comprises a shutter which opens or closes an air path through which floating air is blown, and air volume of the floating air is controlled by an opening or a closing operation of the shutter.

10. The sheet feeding device of claim 8, further comprising a separation air blowing mechanism which blows separation air against a sheet sucked to the suction surface by the sucking and conveying mechanism from a front portion thereof for a sheet conveyance direction.

11. A sheet feeding unit comprising:

(a) at least one sheet tray which stores sheets;

(b) a sheet stacking table that rises and falls in a sheet stacking direction, on which a plurality of sheets are stacked on at least the one sheet tray;

(c) a sucking and conveying mechanism having a sucking surface, which sucks the sheets stacked on the sheet stacking table from an upper surface of the sheets, sucks an uppermost sheet to be sucked on the suction surface, and conveys the uppermost sheet sucked on the suction surface onto a sheet conveyance path;

(d) a floating air blowing mechanism which blows floating air against the sheets from a side surface of the stacked sheets when the sheet is fed from the sheet stacking table;

(e) a sheet position detecting sensor which detects an upper surface position in a vertical direction of the sheets stacked, and detects a floating state of the sheets floated by the floating air; and (f) a controller which judges the floating state of the sheets detected by the sheet position detection sensor in a predetermined finite floating state detecting period in connection with a blowing of the floating air, and controls an air volume of floating air blown from the floating air blowing mechanism based on the floating state of the sheets, wherein the sheet position detecting sensor detects the floating state of the sheets based on a number of turning on-and-off operations thereof in the predetermined finite floating state detecting period;

wherein there is at least one off and one on operation thereof in the predetermined finite floating state detecting period.

12. The sheet feeding device of claim 11, wherein the controller compares the floating state of the sheets detected by the sheet position detecting sensor with a reference value of the floating state, and controls the air volume of the floating air blown from the floating air blowing mechanism based on the comparison result.

13. The sheet feeding device of claim 11, further comprising a memory section which stores a reference value of the floating state, wherein the controller compares the floating state of the sheets detected by the sheet position detecting sensor in the predetermined finite floating state detecting period with the reference value of the floating state stored in the memory, judges whether the floating state is proper or not, and controls the air volume of the floating air based on the judgment result.

14. An image forming apparatus comprising:

(a) an image forming section which forms an image on a sheet;

(b) a sheet feeding device which feeds the sheet onto the image forming section; and (c) a controller which controls the sheet feeding device to feed the sheet onto the image forming section, and controls the image forming section to form the image, wherein the image feeding device comprises:

(1) a sheet stacking table that rises and falls in a sheet stacking direction, on which a plurality of sheets are stacked;

(2) a sucking and conveying mechanism having a suction surface, which sucks the sheets stacked on the sheet stacking table from an upper surface of the sheets, sucks an uppermost sheet to be sucked on the suction surface, and conveys the uppermost sheet sucked on the suction surface onto a sheet conveyance path;

(3) a floating air blowing mechanism which blows floating air against the sheets from a side surface of the stacked sheets when the sheet is fed from the sheet stacking table; and (4) a sheet position detecting sensor which detects an upper surface position in a vertical direction of the sheets stacked, and detects a floating state of the sheets floated by the floating air, wherein the controller judges the floating state of the sheets detected by the sheet position detection sensor in a predetermined finite floating state detecting period in connection with a blowing of the floating air, and controls an air volume of floating air blown from the floating air blowing mechanism based on the floating state of the sheets, wherein the sheet position detecting sensor detects the floating state of the sheets based on a number of turning on-and-off operations thereof in the predetermined finite floating state detecting period;

wherein there is at least one off and one on operation thereof in the predetermined finite floating state detecting period.

15. The sheet feeding device of claim 14, wherein the controller compares the floating state of the sheets detected by the sheet position detecting sensor with a reference value of the floating state, and controls the air volume of the floating air blown from the floating air blowing mechanism based on the comparison result.

16. The sheet feeding device of claim 14, further comprising a memory which stores a reference value of the floating state, wherein the controller compares the floating state of the sheets detected by the sheet position detecting sensor in the predetermined finite floating state detecting period with the reference value of the floating state stored in the memory, judges whether the floating state is proper or not, and controls the air volume of the floating air based on the judgment result.

17. A sheet feeding device comprising:

(a) a sheet stacking table that rises and falls in a sheet stacking direction, on which a plurality of sheets are stacked;

(b) a conveyer which conveys an uppermost sheet on the suction surface onto a sheet conveyance path;

(c) a floating air generator which generates floating air against the sheets from a side surface of the stacked sheets when the sheet is fed from the sheet stacking table;

(d) a sheet position detecting sensor which detects an upper surface position in a vertical direction of the sheets stacked, and detects a floating state of the sheets floated by the floating air; and (e) a controller which judges the floating state of the sheets detected by the sheet position detection sensor in a predetermined finite floating state detecting period in connection with a blowing of the floating air, and controls an air volume of floating air generated by the floating air generator based on the floating state of the sheets, wherein the sheet position detecting sensor detects the floating state of the sheets based on a number of turning on-and-off operations thereof in the predetermined finite floating state detecting period;

wherein there is at least one off and one on operation thereof in the predetermined finite floating state detecting period.

* * * * *